United States Patent [19]

Ely

[11] Patent Number: 4,850,121

[45] Date of Patent: Jul. 25, 1989

[54] DRYER FELT RUN

[75] Inventor: Donald A. Ely, Roscoe, Ill.

[73] Assignee: Beloit Corporation, Beloit, Wis.

[21] Appl. No.: 871,393

[22] PCT Filed: Apr. 21, 1986

[86] PCT NO.: PCT US86/00799

§ 371 Date: Apr. 21, 1986

§ 102(e) Date: Apr. 21, 1986

[87] PCT Pub. No.: WO87/06635

PCT Pub. Date: Nov. 5, 1987

[51] Int. Cl.[4] ..... F26B 11/02

[52] U.S. Cl. ..... 34/116; 34/114

[58] Field of Search ..... 34/114, 116, 117, 120, 34/122, 123

[56] References Cited

U.S. PATENT DOCUMENTS 2,910,784 11/1959 Metcalfe ..... 34/114

3,303,576 2/1967 Sisson ..... 34/122

3,751,822 8/1973 Crist ..... 34/116

3,868,780 3/1975 Soininen et al. ..... 34/116

4,483,083 11/1984 Chance ..... 34/116

*Primary Examiner*—Henry A. Bennet

*Attorney, Agent, or Firm*—Dirk J. Veneman; Raymond W. Campbell; David J. Archer

[57] ABSTRACT

A paper web drier section (5) has horizontal upper and lower tiers of dryers (7, 8) defining generally triangular pockets (9). An endless drier felt (10) is trained to run a paper web (W) sinuously successively and in direct contact on the upper perimeter areas of the upper (7) and lower (8) tier driers. Broke is ejected downwardly from the pocket (9). To facilitate such broke ejection, drier felt roll wrap enhancing felt rolls (19, 20) in the pockets are especially oriented for this purpose and define a respective broke-receiving and ejecting sub-pocket (21) under the upper tier driers (7) at each pocket (9).

4 Claims, 1 Drawing Sheet

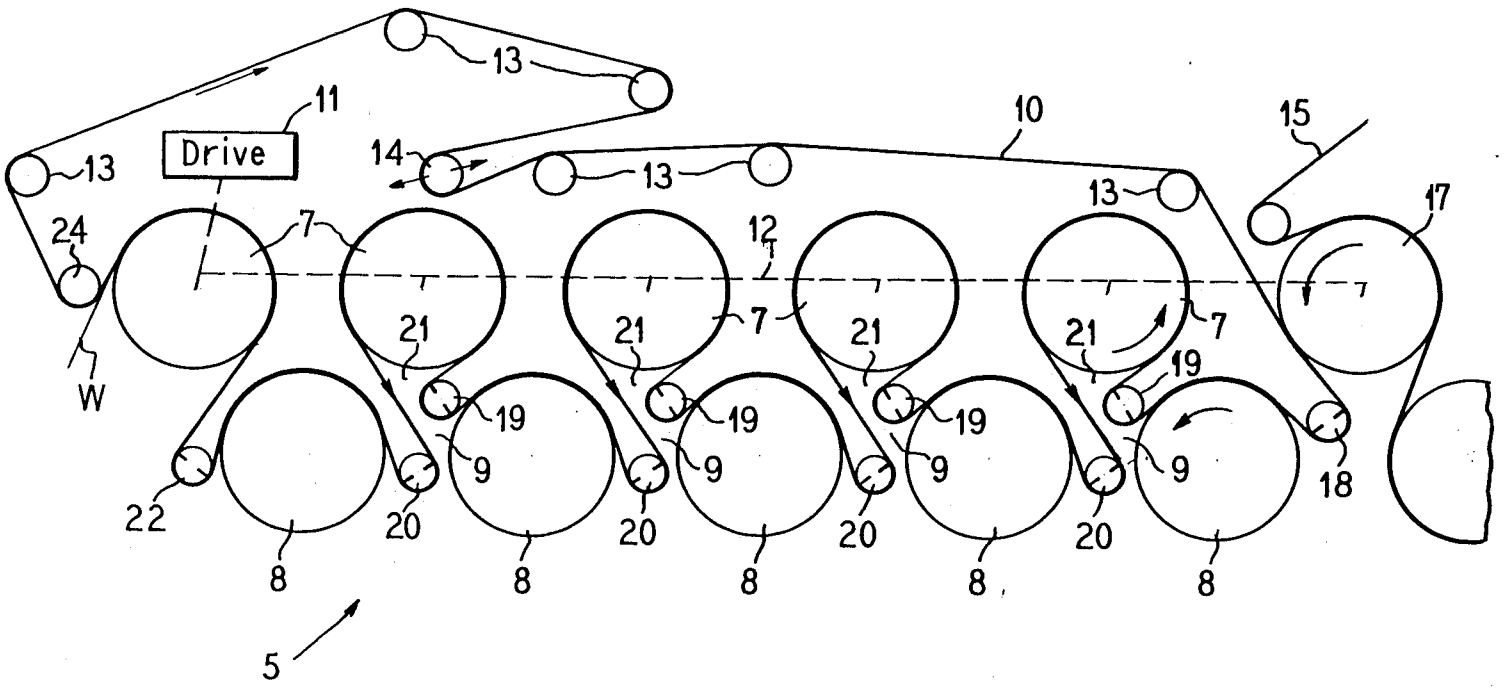
Drive
5
7
8
9
10
11
12
13
14
15
17
18
19
20
21
22
24
W

DRYER FELT RUN

DESCRIPTION

This invention relates in general to the paper making art, and is more particularly concerned with a new and improved method of and apparatus for drying freshly formed paper web.

As is customary in the paper making industry, after the paper web has been formed from a water slurry of paper stock, the web is dried by traveling through one or more drier sections aided by means of endless porous belts commonly referred to as drier felts regardless of their composition. These drier felts support and guide the web over and in contact with one or more series of heated drier rolls. In some drier section installations, the heated drier rolls are arranged in vertical stacks. In other drier installations, the rolls are arranged in horizontal tiers, and it is to the horizontal arrangement that the present invention is directed.

It has been found that single drier felt carrying and guiding of the paper web is, at least for some grades of paper web, more efficient because the web is caused to travel directly in contact with the heated drier rolls. By way of example of single felt, and direct web contact with the drier rolls, U.S. Pat. No. 3,868,780 is referred to. In the disclosure of that patent, both vertical and horizontal stack arrangements of the drier rolls are disclosed, and guide rollers are provided for assuring reasonable wrap of the web on the drier roll perimeters.

On the other hand, for more efficient drying in one pass travel through the horizontal drier section, the web should be guided by the drier felt in a path which causes the web to wrap drying cylinders, or drier rolls, and hereinafter identified as dryers, in both an upper and a lower tier. To attain this result, guide rollers are required to be located within the fairly restricted working space afforded in the generally triangular pockets defined between the upper and lower tiers of dryers. That may present a problem of handling the broke in the event of a break in the web. The apparatus and method of the present invention solve that problem.

To this end, the present invention provides a paper web drier section having an upper horizontal tier of a plurality of dryers spaced from one another less than the diameter of the dryers, a lower horizontal tier of dryers spaced from one another and adjacently spaced from the upper tier dryers, and with the upper tier dryers forming with the lower tier dryers respectively generally triangular pockets. An endless drier felt is trained to run a paper web sinuously successively in direct contact on the upper perimeter areas of the upper and lower tier dryers. All of the dryers and the felt run in the same direction. A pair of felt rolls is located in each pocket for maximizing the wrap of the felt, and thereby the web, on the dryer perimeters. A first of the pair of felt rolls in each pocket is located for controlling running of the felt and web from the lower tier dryer located at the onrunning side of the pocket and into the pocket and then onto the onrunning side of the upper tier dryer defining the pocket. The other of the pair of felt rolls in each pocket controls running of the felt and web from the offrunning side of the upper tier dryer back into the pocket and then onto the onrunning side of the lower tier dryer at the offrunning side of the pocket. The other felt roll forms with the drier felt and the first felt roll a generally downwardly opening broke receiving and ejecting sub-pocket within the dryerdefined pocket.

The foregoing described apparatus is utilized to practice the method of so guiding the web in the dryer pockets that broke is purged therefrom.

There are no open draws throughout the drying process in the drier section. The paper web is supported continually by the drier felt.

Other objects, features and advantages of the invention will be readily apparent from the following description of the representative embodiments thereof, taken in conjunction with the accompanying drawings, although variations and modifications may be effected without departing from the spirit and scope of the novel concepts embodied in the disclosure, and in which:

The FIGURE is a schematic illustration of a horizontal drier section embodying the invention.

A typical two tier horizontal drier section 5 is shown in the drawing. This drier section may be used along or may be one of a series of drier sections, depending upon particular requirements dictated by any of the numerous parameters that may be involved in making any particular paper. An upper horizontal tier of a plurality of dryers 7, herein shown as five in number, and spaced from one another less than the diameter of the dryers, cooperates with a lower horizontal tier of dryers herein shown as five in number, which are spaced from one another and adjacently spaced from the upper tier dryers. The upper tier dryers 7 are relatively offset with respect to the lower tier dryers 8 and define therewith respective generally triangular pockets 9.

An endless drier felt 10 is trained to run a paper web W sinuously, successively and in direct contact on the upper perimeter areas of the upper and lower tier dryers in a manner avoiding any open draw of the web. That is, the web W is at all times, in running through the drier section 5, in contact with the drier felt 10.

Conventional means, identified schematically as a drive 11, are provided for driving all of the dryers 7 and 8 and the felt 10 in one direction, that is from the right to the left as viewed in the drawing. Although the drive means may be of the kind which will positively drive all of the dryers 7 and 8 in coordinated relation, it may be sufficient merely to drive the upper tier dryers 7 and rely upon tensioning of the drier felt 10 to drive the lower dryers 8. In this instance, a common gear drive 12 is schematically depicted for the upper dryers 7. Various guide rollers 13 are shown for controlling the return run of the drier felt 10. A tensioning roller 14 permits adjusting the drier felt tension.

The paper web W to be dried may be delivered to the entry end of the drier section 5 as by means of a delivery belt or felt 15 which partially wraps a roll 17 and from which the wet web is transferred to the drier run of the felt 10. After the web has been transferred to the felt 10, a guide roller 18 guides the drier felt and the web W carried thereby onto the first in the series of lower dryers 8 and on the perimeter of which there is a partial wrap of the felt. The web W is in direct contact with the dryer 8 as the felt 10 runs to a vacuum or grooved or plain felt roll 19 depending upon speed of machine and weight of the web within the first dryer-defined pocket 9. The roll 19 functions in cooperation with the guide roller 18 to improve the extent of drying wrap on the perimeter of the first lower tier dryer 8.

The felt roll 19 also functions for controlling running of the drier felt 10 and the carried paper web W from the first lower tier dryer 8 at the onrunning side of the first pocket 9 into such pocket and then in onrunning direction onto the upper tier dryer 7 defining the pocket. In effect, the felt roll 19 tucks the felt 10 and the carried web W generally under the onrunning side of the dryer 7 for maximizing wrap of the felt and web about the perimeter of the dryer 7.

Under the offrunning side of the upper dryer 7, a second vacuum felt roll 20 controls running of the felt 10 and web W into the pocket 9 and then onto the onrunning side of the next succeeding lower tier dryer 8. As will be observed, the felt roll 20 forms with the drier felt 10 and the felt roll 19 a generally downwardly opening broke-receiving and ejecting subpocket 21 within the pocket 9 under the associated upper tier dryer 7. Should there be a break in the paper web W resulting in broke, the broke will be influenced by the downrunning felt toward and about the felt roll 20 to be diverted away from the dryer 7 past the felt roll 19 toward the onrunning side dryer 8 which is travelling peripherally in the same direction as the felt 10 is travelling toward the felt roll 20. Thereby, the broke tends to be ejected downwardly away from the drier section 5 without clogging the drier system. Rethreading the paper web through the drier section is thus facilitated.

In each succeeding pocket 9, there is the same arrangement of first and second felt rolls 19 and 20 and subpocket 21 to the same effect as described in connection with the first of the pockets 9 and its subpocket in the series. Any or all of the felt rolls 18, 19 and 20 are desirably suction rolls although they may be grooved or plain.

From the offrunning end of the drier section 5, the drier felt 10 and the web W carried thereby may be guided away from the last lower dryer 8 by means of a felt roll 22 to run onto the final dryer 7, in the upper tier of dryers. From the final dryer 7, the drier felt 10 and web W may be guided by a felt roll 24 for directing the web to diverge from the start of the return run of the felt 10 and away from the last dryer 7 for further processing.

The drier felt 10 should have a smooth surface on its surface which engages the web W, and with a permeability of between 25 and 100 CFM at $\frac{1}{2}''$ $H_2O$ pressure per sq. ft.

It will be understood that variations and modifications may be effected without departing from the spirit and scope of the novel concepts of this invention.

I claim:

1. A paper web dryer section comprising:

an upper horizontal tier of a plurality of rotary dryers spaced from one another less than the diameter of the dryers;

a lower horizontal tier of rotary dryers spaced from one another and adjacently spaced from said upper dryers, and with said upper dryers forming with the lower dryers respective generally triangular pockets;

an endless dryer felt trained to run a paper web sinuously successively and in direct contact on the upper perimeter areas of said upper and lower dryers;

means for effecting running of all of said dryers and said felt in one direction;

a pair of felt rolls in each pocket for maximizing the wrap of the felt, and thereby the web, on the dryer perimeters, a first of said pair of felt rolls in each pocket located for controlling running of said felt and web from the lower dryer located at an onrunning side of the pocket into said pocket and then in an onrunning direction onto the upper dryer defining the pocket and a second of said pair of felt rolls in each pocket controlling running of the felt and web from an offrunning side of the upper dryer into the pocket and then onto an onrunning side of the lower dryer at an offrunning side of said pocket, and said second felt roll forming with the dryer felt and said first felt roll a generally downwardly opening broke receiving and ejection subpocket under said upper dryer and within said pocket; and said first felt rolls being located generally above said second felt rolls to form a short tuck of the felt into said pockets.

2. A paper web dryer section comprising:

an upper horizontal tier of a plurality of rotary dryers spaced from one another less than the diameter of the dryers;

a lower horizontal tier of rotary dryers spaced from one another and adjacently spaced from said upper dryers, and with said upper dryers forming with the lower dryers respective generally triangular pockets;

an endless dryer felt trained to run a paper web sinuously successively and in direct contact on the upper perimeter areas of said upper and lower dryers;

means for effecting running of all of said dryers and said felt in one direction;

a pair of felt rolls in each pocket for maximizing the wrap of the felt, and thereby the web, on the dryer perimeters, a first of said pair of felt rolls in each pocket located for controlling running of said felt and web from the lower dryer located at an onrunning side of the pocket into said pocket and then in an onrunning direction onto the upper dryer defining the pocket and a second of said pair of felt rolls in each pocket controlling running of the felt and web from an offrunning side of the upper dryer into the pocket and then onto an onrunning side of the lower dryer at an offrunning side of said pocket, and said second felt roll forming with the dryer felt and said first felt roll a generally downwardly opening broke receiving and ejection subpocket under said upper dryer and within said pocket; and said first felt rolls being located generally above said second felt rolls within said pockets.

3. A method of operating a paper web dryer section having an upper horizontal tier of a plurality of rotary dryers spaced from one another less than the diameter of the dryers, a lower horizontal tier of rotary dryers spaced from one another and adjacently spaced from said dryers, and with said upper dryers forming with the lower dryers respective generally triangular pockets;

running a paper web on an endless dryer felt sinuously successively and in direct contact on the upper perimeter areas of said upper and lower dryers;

running all of said dryers and said felt carrying said web in one direction;

maximizing the wrap of the felt, and thereby the web, on the dryer perimeters by running the felt over and about the pair of felt rolls in each pocket;

by a first of said pair of felt rolls in each pocket controlling running the felt and web from the lower dryer located at the onrunning side of the pocket into said pocket and then in an onrunning direction onto the upper dryer defining the pocket;

by means of a second of said pair of felt rolls in each pocket controlling running of the felt and web from the offrunning side of the upper dryer into the pocket and then onto the onrunning side of the lower dryer at the offrunning side of said pocket; and by means of said second felt roll forming with the dryer felt and said first felt roll a generally downwardly opening broke receiving ejection subpocket within said pocket.

4. A method of operating a paper web dryer section having an upper horizontal tier of a plurality of rotary dryers spaced from one another less than the diameter of the dryers, a lower horizontal tier of rotary dryers spaced from one another and adjacently spaced from said dryers, and with said upper dryers forming with the lower dryers respective generally triangular pockets comprising the steps of:

locating said first felt roll above the second felt roll in said pocket, and forming a short tuck of the felt into the pocket;

running a paper web on an endless dryer felt sinuously successively and in direct contact on the upper perimeter areas of said upper and lower dryers;

running all of said dryers and said felt carrying said web in one direction;

maximizing the wrap of the felt, and thereby the web, on the dryer perimeters by running the felt over and about a pair of felt rolls in each pocket;

by a first of said pair of felt rolls in each pocket controlling running the felt and web from the lower dryer located at the onrunning side of the pocket into said pocket and then in an onrunning direction onto the upper dryer defining the pocket;

by means of a second of said pair of felt rolls in each pocket controlling running of the felt and web from the offrunning side of the upper dryer into the pocket and then onto the onrunning side of the lower dryer at the offrunning side of said pocket; and by means of said second felt roll forming with the dryer felt and said first felt roll a generally downwardly opening broke receiving and ejection subpocket within said pocket.

* * * * *